US008262217B2

(12) United States Patent
Furukawa

(10) Patent No.: US 8,262,217 B2
(45) Date of Patent: Sep. 11, 2012

(54) INKJET RECORDING APPARATUS AND METHOD

(75) Inventor: Koji Furukawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 272 days.

(21) Appl. No.: 12/698,555

(22) Filed: Feb. 2, 2010

(65) Prior Publication Data

US 2010/0194815 A1 Aug. 5, 2010

(30) Foreign Application Priority Data

Feb. 3, 2009 (JP) ..... 2009-022854
Feb. 4, 2009 (JP) ..... 2009-023871

(51) Int. Cl.
*B41J 2/01* (2006.01)

(52) U.S. Cl. ..... 347/104; 347/103

(58) Field of Classification Search ..... 347/3, 16, 347/96, 104, 103, 101, 33, 99, 88
See application file for complete search history.

(56) References Cited

U.S. PATENT DOCUMENTS

| | | | | |
|---|---|---|---|---|
| 5,619,240 | A | 4/1997 | Pong et al. | |
| 6,030,674 | A | 2/2000 | Onishi et al. | |
| 6,122,464 | A | 9/2000 | Kakigi | |
| 6,820,975 | B2 * | 11/2004 | Sugaya et al. | 347/104 |
| 7,845,788 | B2 * | 12/2010 | Oku | 347/103 |
| 2005/0012798 | A1 * | 1/2005 | Adachi et al. | 347/100 |

FOREIGN PATENT DOCUMENTS

| | | | |
|---|---|---|---|
| EP | 0 316 198 | A2 | 5/1989 |
| JP | 6-230698 | A | 8/1994 |
| JP | 8-171323 | A | 7/1996 |
| JP | 2006 347666 | A | 12/2006 |

OTHER PUBLICATIONS

Machine translation of JP 08-171323.*
Machine translation of JP 2006-347666.*
European Search Report issued in corresponding EP application No. 10152377.7-1251 on Mar. 31, 2010.

* cited by examiner

*Primary Examiner* — Julian Huffman
*Assistant Examiner* — Sharon A Polk
(74) *Attorney, Agent, or Firm* — Birch, Stewart, Kolasch & Birch, LLP

(57) ABSTRACT

The inkjet recording apparatus includes: an inkjet head which forms an image on a recording surface of a recording medium by ejecting ink to be deposited to the recording surface; a roller member which rotates in contact with the recording surface of the recording medium on which the image has been formed; an oil supply device which supplies oil to the roller member, the oil suppressing adherence of the ink to the roller member; a medium holding device which has a medium holding surface on which the recording medium is held while the roller member on which the oil has been deposited is making contact with the recording surface of the recording medium; and a cleaning sheet supply device which supplies a cleaning sheet to the medium holding device when a size of the recording medium is changed and an image is to be formed on a recording surface of the recording medium of large size compared to a size of the recording medium used before the change of size, the cleaning sheet removing the oil adhering to the medium holding surface of the medium holding device.

18 Claims, 7 Drawing Sheets

INKJET RECORDING APPARATUS AND METHOD

BACKGROUND OF THE INVENTION

1. Field of the Invention

The present invention relates to an inkjet recording apparatus and an inkjet recording method, and more particularly to inkjet recording technology which prevents parting oil applied to the surface of a roller that contacts the image surface of a recording medium after image formation from adhering to the rear surface of the recording medium via the recording medium holding and conveyance system.

2. Description of the Related Art

Japanese Patent Application Publication No. 08-171323 discloses an electrophotographic recording apparatus, in which a sheet holding surface is cleaned using an oil absorbing cleaning sheet after recording onto a second sheet surface, in respect of the problem of oil component (parting oil) that is adhering to a first sheet surface becoming attached to the sheet holding surface when the second sheet surface (rear surface) is recorded after recording the first sheet surface.

However, the object of the technology in Japanese Patent Application Publication No. 08-171323 is to remove parting oil which has transferred from the first sheet surface (front surface) during double-side printing, and although this technology can respond to image formation defects when carrying out the next printing operation after one cycle of double-side printing, it does not take account of image formation defects occurring due to the adherence of the parting oil which is applied to the fixing roller, or the like, to the portion of the paper supporting section (pressure drum, or the like) where paper is not passed.

In particular, if the size of the recording medium is changed from a small size to a large size and a recording medium of large size after the change passes a position where the recording medium was not passed before the change, then there is a problem in that parting oil adhering to the portion where the small sheet of recording medium has not passed will adhere to the rear surface of the large sheet of recording medium.

If an image is formed on the rear surface of the recording medium in a state where parting oil is adhering to the rear surface in this way, then image non-uniformities result and the quality of the output image declines.

Japanese Patent Application Publication No. 06-230698 discloses a cleaning sheet for a fixing roller in a copying machine, in which the main components of the cleaning sheet material are: heat-resistant polymer fibers in the form of tissue, heat-resistant polymer fibers in the form of fibrils, and inorganic fibers having a diameter of 2 μm or less.

However, in Japanese Patent Application Publication No. 06-230698, although conditions are specified for achieving a good balance between oil permeability and holding properties, in such a manner that good oil supply to the fixing roller and good cleaning can be achieved, no mention is made of suitable conditions for removing oil which has adhered to the paper holding portion as described above (oil removing characteristics and sheet passage characteristics).

SUMMARY OF THE INVENTION

The present invention has been contrived in view of these circumstances, an object thereof being to provide an inkjet recording apparatus and an inkjet recording method which resolve the aforementioned problems by preventing adherence of oil to a recording medium and enabling good image formation.

In order to attain the aforementioned object, the present invention is directed to an inkjet recording apparatus, comprising: an inkjet head which forms an image on a recording surface of a recording medium by ejecting ink to be deposited to the recording surface; a roller member which rotates in contact with the recording surface of the recording medium on which the image has been formed; an oil supply device which supplies oil to the roller member, the oil suppressing adherence of the ink to the roller member; a medium holding device which has a medium holding surface on which the recording medium is held while the roller member on which the oil has been deposited is making contact with the recording surface of the recording medium; and a cleaning sheet supply device which supplies a cleaning sheet to the medium holding device when a size of the recording medium is changed and an image is to be formed on a recording surface of the recording medium of large size compared to a size of the recording medium used before the change of size, the cleaning sheet removing the oil adhering to the medium holding surface of the medium holding device.

In order to attain the aforementioned object, the present invention is also directed to an inkjet recording method comprises the steps of: forming an image on a recording surface of a recording medium by depositing ink ejected from an inkjet head onto the recording surface; supplying oil to a roller member which rotates in contact with the image recording surface of the recording medium on which the image has been formed, the oil suppressing adherence of the ink to the roller member; causing the roller member on which the oil has been deposited to make contact with the recording surface of the recording medium on which the image has been formed in a state where the recording medium is held on a medium holding surface of a medium holding device; and supplying a cleaning sheet to the medium holding device when a size of the recording medium is changed and an image is to be formed on a recording surface of the recording medium of large size compared to a size of the recording medium used before the change of size, the cleaning sheet removing the oil adhering to the medium holding surface of the medium holding device.

From the viewpoint of achieving both good oil removal characteristics and good sheet passage characteristics, it is desirable to use the cleaning sheet having the Bristow permeability coefficient with respect of water of not less than 0.1 $ml/(m^2 \cdot msec^{1/2})$ and not more than 0.5 $ml/(m^2 \cdot msec^{1/2})$, and more desirably, not less than 0.2 $ml/(m^2 \cdot msec^{1/2})$. Furthermore, desirably, the surface roughness of the surface of the cleaning sheet on the side that makes contact with the medium holding surface of the medium holding device is desirably not less than 0.2 μm and not more than 2.0 μm, and more desirably, not more than 1.0 μm, in terms of a center-line average roughness (Ra).

According to the present invention, when the size of the recording medium is changed to a large size, the cleaning sheet is supplied to the medium holding device, and the oil adhering to the portion which has not been passed by the recording medium of small size that has been used prior to the size change is absorbed and removed by the cleaning sheet. Therefore, it is possible to prevent the oil from adhering to the recording medium of large size after the size change. Moreover, the cleaning sheet according to the present invention satisfies a good balance between the adherence characteristics with respect to the medium holding surface of the medium holding device (in other words, oil removal characteristics), and sheet passage characteristics.

DESCRIPTION OF THE PREFERRED EMBODIMENTS

Entire Configuration of Inkjet Recording Apparatus

Figure 1:
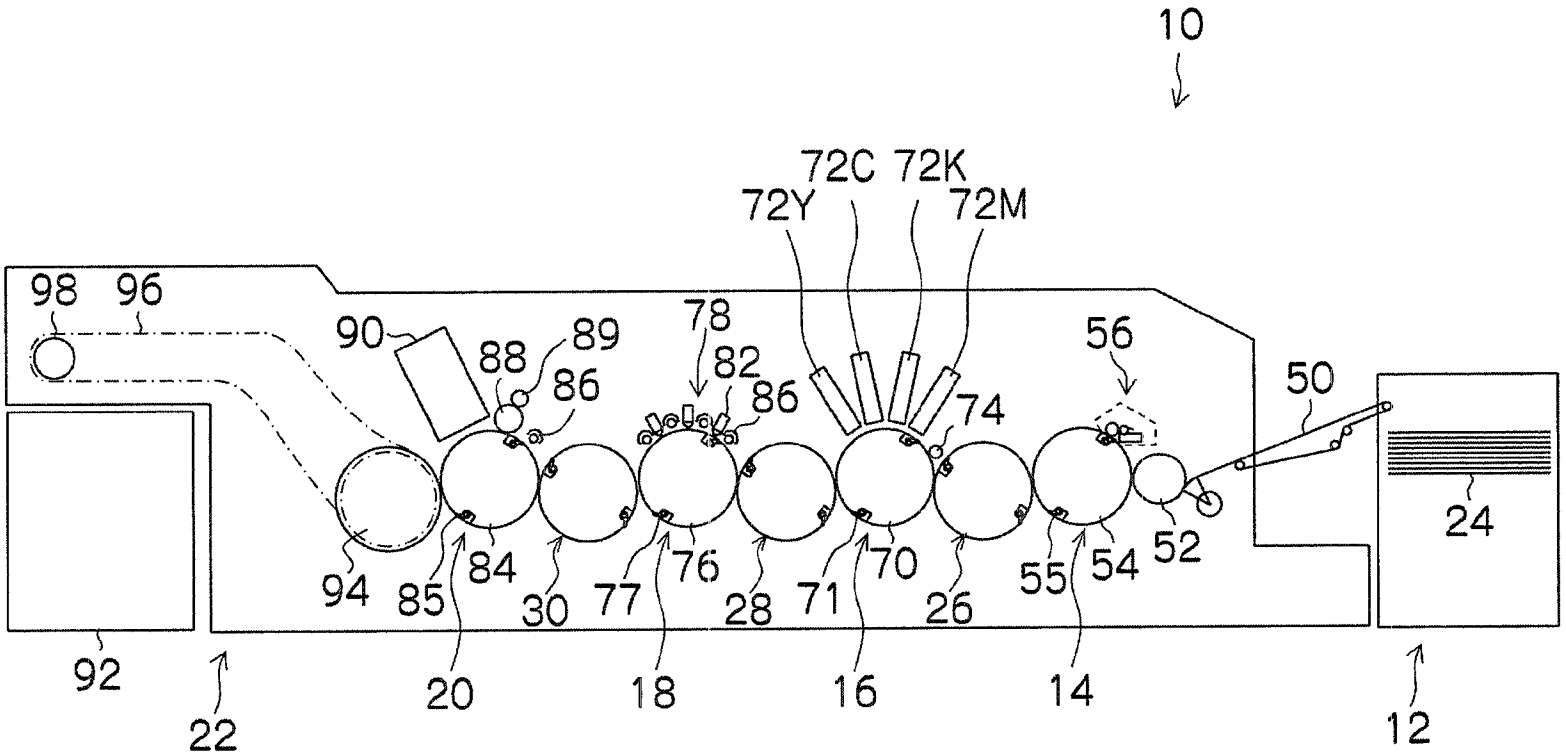
FIG. 1 is a schematic structural diagram illustrating an inkjet recording apparatus according to an embodiment of the present invention.

FIG. 1 is a structural diagram illustrating the configuration of an inkjet recording apparatus 10 according to an embodiment of the present invention. The inkjet recording apparatus 10 is an inkjet recording apparatus of a so-called pressure-drum direct image-formation system which records a desired color image on a recording medium (hereinafter also referred to as "paper") 24 held on a pressure drum (an image formation drum 70) of an image formation unit 16 by ejecting and depositing droplets of ink of a plurality of colors from inkjet heads 72M, 72K, 72C and 72Y onto the recording medium 24. More specifically, the inkjet recording apparatus 10 is a recording apparatus of a on-demand type which adapts a two-liquids reaction (aggregation in the present embodiment) system in which treatment liquid (aggregation treatment liquid in the present embodiment) is applied onto the recording medium 24 prior to the deposition of the ink, so that the deposited ink reacts with the treatment liquid to form images on the recording medium 24.

The inkjet recording apparatus 10 includes a paper feed unit 12, a treatment liquid application unit 14, the image formation unit 16, a drying unit 18, a fixing unit 20, and a discharge unit 22 as the main components.

The recording medium 24 (paper sheets) is stacked in the paper feed unit 12, and the recording medium 24 is fed from the paper feed unit 12 to the treatment liquid application unit 14. The treatment liquid is applied to the recording surface in the treatment liquid application unit 14, and then a color ink is applied to the recording surface in the image formation unit 16. The image is fixed with the fixing unit 20 on the recording medium 24 onto which the ink has been applied, and then the recording medium is discharged with the discharge unit 22.

Each unit (paper feed unit 12, treatment liquid application unit 14, image formation unit 16, drying unit 18, fixing unit 20, and discharge unit 22) of the inkjet recording apparatus 10 will be described below in greater details.

<Paper Feed Unit>

The paper feed unit 12 feeds the recording medium 24 to the image formation unit 16. A paper feed tray 50 is provided in the paper feed unit 12, and the recording medium 24 is fed, sheet by sheet, from the paper feed tray 50 to the treatment liquid application unit 14.

In the inkjet recording apparatus 10 according to the present embodiment, it is possible to use recording media 24 of different types and various sizes as the recording medium 24. A mode can be adopted in which the paper feed unit 12 is provided with a plurality of paper trays (not illustrated) in which recording media of different sizes are respectively sorted and stacked, and the paper that is fed to the paper feed tray 50 from the paper trays is automatically switched, and a mode can also be adopted in which an operator selects or exchanges the paper tray in accordance with requirements.

In the present embodiment, cut sheets of paper are used as the recording media 24, but it is also possible to cut paper to a required size from a continuous roll of paper and then supply this paper.

Furthermore, the paper feed unit 12 according to the present embodiment may also be used as a device for supplying a cleaning sheet (not illustrated). It is also possible to adopt a mode in which the paper feed unit 12 is provided with a paper tray (not illustrated) in which cleaning sheets are stacked and, similarly to a change in the type (size) of the recording medium 24 for printing, the paper supply path is switched by automatic control in such a manner that the cleaning sheet is supplied from the cleaning sheet paper tray, and it is also possible to adopt a mode in which the cleaning sheet paper tray is selected or changed by an operator, according to requirements.

<Treatment Liquid Application Unit>

The treatment liquid application unit 14 is a mechanism that applies the treatment liquid to the recording surface of the recording medium 24. The treatment liquid includes a coloring material aggregating agent that causes the aggregation of a coloring material (pigment in the present embodiment) included in the ink applied in the image formation unit 16, and the separation of the coloring material and a solvent in the ink is enhanced when the treatment liquid is brought into contact with the ink.

As shown in FIG. 1, the treatment liquid application unit 14 includes a paper transfer drum 52, a treatment liquid drum 54, and a treatment liquid application device 56. The paper transfer drum 52 is disposed between the paper feed tray 50 of the paper feed unit 12 and the treatment liquid drum 54. The rotation of the paper transfer drum 52 is driven and controlled by a below-described motor driver 176 (see FIG. 5). The recording medium 24 fed from the paper feed unit 12 is received by the paper transfer drum 52 and transferred to the treatment liquid drum 54.

The treatment liquid drum 54 is a drum that holds and rotationally conveys the recording medium 24. The rotation of the treatment liquid drum 54 is driven and controlled by the below-described motor driver 176 (see FIG. 5). Further, the treatment liquid drum 54 is provided on the outer circumferential surface thereof with a hook-shaped holding device (gripper) 55. The holding device (gripper) 55 holds the leading end of the recording medium 24 by gripping the recording medium 24 between the hook of the gripper 55 and the circumferential surface of the treatment liquid drum 54. In a state in which the leading end of the recording medium 24 is held by the holding device 55, the treatment liquid drum 54 is rotated to convey rotationally the recording medium 24. In this case, the recording medium 24 is conveyed so that the recording surface thereof faces outward. The treatment liquid drum 54 may be provided with suction apertures on the outer circumferential surface thereof and connected to a suction device that performs suction from the suction apertures. As a result, the recording medium 24 can be tightly held on the outer circumferential surface of the treatment liquid drum 54.

The treatment liquid application device 56 is provided on the outside of the treatment liquid drum 54 opposite the outer circumferential surface thereof. The treatment liquid application device 56 applies the treatment liquid onto the recording surface of the recording medium 24. The treatment liquid application device 56 includes: a treatment liquid container, in which the treatment liquid to be applied is held; an anilox roller, a part of which is immersed in the treatment liquid held in the treatment liquid container; and a rubber roller, which is pressed against the anilox roller and the recording medium 24 that is held by the treatment liquid drum 54, so as to transfer the treatment liquid metered by the anilox roller to the recording medium 24. The treatment liquid application device 56 can apply the treatment liquid onto the recording medium 24 while metering.

It is preferred that the film thickness of the treatment liquid be sufficiently smaller than the diameter of ink droplets that are ejected and deposited by the inkjet heads 72M, 72K, 72C and 72Y of the image formation unit 16. For example, when the ink droplet volume is 2 picoliters (pl), the average diameter of the droplet is 15.6 μm. In this case, when the film thickness of the treatment liquid is large, the ink droplet would be suspended in the treatment liquid, without coming into contact with the surface of the recording medium 24, and then the ink droplet would not spread to form a dot having a desired diameter. Accordingly, when the ink droplet volume is 2 pl, it is preferred that the film thickness of the treatment liquid be not more than 3 μm in order to obtain a deposited dot diameter not less than 30 μm.

In the present embodiment, the application system using the roller is used to deposit the treatment liquid onto the recording surface of the recording medium 24; however, the present invention is not limited to this, and it is possible to employ a spraying method, an inkjet method, or other methods of various types.

The recording medium 24 that has been applied with the treatment liquid in the treatment liquid application unit 14 is transferred from the treatment liquid drum 54 through the intermediate conveyance unit 26 to the image formation drum 70 of the image formation unit 16.

<Image Formation Unit>

The image formation unit 16 is a mechanism which prints an image corresponding to an input image by ejecting and depositing droplets of ink by an inkjet method, and the image formation unit 16 includes the image formation drum 70, a paper pressing roller 74 and the inkjet heads 72M, 72K, 72C and 72Y. The inkjet heads 72M, 72K, 72C and 72Y correspond to inks of four colors: magenta (M), black (K), cyan (C) and yellow (Y), and are disposed in the order of description from the upstream side in the rotation direction of the image formation drum 70.

The image formation drum 70 is a drum that holds the recording medium 24 on the outer circumferential surface thereof and rotationally conveys the recording medium 24. The rotation of the image formation drum 70 is driven and controlled by the below-described motor driver 176 (see FIG. 5). Similar to the treatment liquid drum 54, the image formation drum 70 is provided on the outer circumferential surface thereof with a hook-shaped holding device (gripper) 71, which can hold the recording medium 24 by gripping the leading end portion of the recording medium 24. The recording medium 24 is rotationally conveyed by the rotation of the image formation drum 70 in a state where the leading end portion is held by the holding device 71. In this case, the recording medium 24 is conveyed in a state where the recording surface thereof faces outward, and inks are deposited on the recording surface by the inkjet heads 72M, 72K, 72C and 72Y.

The paper pressing roller 74 is a guide member for causing the recording medium 24 to tightly adhere to the outer circumferential surface of the image formation drum 70, and is arranged to face the outer circumferential surface of the image formation drum 70. More specifically, the paper pressing roller 74 is disposed to the downstream side of the position where the recording medium 24 is received from the intermediate conveyance unit 26, and to the upstream side from the inkjet heads 72M, 72K, 72C and 72Y, in terms of the direction of conveyance of the recording medium 24 (the direction of rotation of the image formation drum 70).

When the recording medium 24 that has been transferred onto the image formation drum 70 from the intermediate conveyance unit 26 is rotationally conveyed in a state where the leading end portion of the recording medium 24 is held by the holding device 71, the recording medium 24 is pressed by the paper pressing roller 74 so as to make the recording medium 24 adhere tightly to the outer circumferential surface of the image formation drum 70. When the recording medium 24 has been made to tightly adhere to the outer circumferential surface of the image formation drum 70 in this way, the recording medium 24 is conveyed to a print region directly below the inkjet heads 72M, 72K, 72C and 72Y in a state where the recording medium 24 does not float up from the outer circumferential surface of the image formation drum 70.

The inkjet heads 72M, 72K, 72C and 72Y are recording heads (inkjet heads) of the inkjet system of the full line type that have a length corresponding to the maximum width of the image formation region in the recording medium 24. A nozzle row is formed on the ink ejection surface of the inkjet head. The nozzle row has a plurality of nozzles arranged therein for discharging ink over the entire width of the image recording region. Each inkjet head 72M, 72K, 72C, 72Y is fixedly disposed so as to extend in the direction perpendicular to the conveyance direction (rotation direction of the image formation drum 70) of the recording medium 24.

Droplets of corresponding colored inks are ejected from the inkjet heads 72M, 72K, 72C and 72Y having the above-described configuration toward the recording surface of the recording medium 24 held on the outer circumferential surface of the image formation drum 70. As a result, the ink comes into contact with the treatment liquid that has been heretofore applied on the recording surface by the treatment liquid application unit 14, the coloring material (pigment) dispersed in the ink is aggregated, and a coloring material aggregate is formed. Therefore, the coloring material flow on the recording medium 24 is prevented and an image is formed on the recording surface of the recording medium 24. In this case, because the image formation drum 70 of the image formation unit 16 is structurally separated from the treatment liquid drum 54 of the treatment liquid application unit 14, the treatment liquid does not adhere to the inkjet heads 72M, 72K, 72C and 72Y, and the number of factors preventing the ejection of ink can be reduced.

In the present embodiment, the CMYK standard color (four colors) configuration is described, but combinations of ink colors and numbers of colors are not limited to that of the present embodiment, and if necessary, light inks, dark inks, and special color inks may be added. For example, a configuration is possible in which inkjet heads are added that eject light inks such as light cyan and light magenta. The arrangement order of color heads is also not limited.

The recording medium 24 on which the image has been formed in the image formation unit 16 is transferred from the image formation drum 70 through an intermediate conveyance unit 28 to a drying drum 76 of the drying unit 18.

<Drying Unit>

The drying unit 18 dries water included in the solvent separated by the coloring material aggregation action. As shown in FIG. 1, the drying unit includes the drying drum 76 and a solvent dryer 78.

The drying drum 76 is a drum that holds the recording medium 24 on the outer circumferential surface thereof and rotationally conveys the recording medium 24. The rotation of the drying drum 76 is driven and controlled by the below-described motor driver 176 (see FIG. 5). Similar to the treatment liquid drum 54, the drying drum 76 is provided on the outer circumferential surface thereof with a hook-shaped holding device (gripper) 77, which can hold the recording medium 24 by gripping the leading end portion of the recording medium 24. The recording medium 24 is rotationally conveyed by the rotation of the drying drum 76 in a state where the leading end portion is held by the holding device 77. In this case, the recording medium 24 is conveyed in a state where the recording surface thereof faces outward, and the drying treatment is carried out by the solvent dryer 78 with respect to the recording surface of the recording medium 24. The drying drum 76 may be provided with suction apertures on the outer circumferential surface thereof and connected to a suction device that performs suction from the suction apertures. As a result, the recording medium 24 can be tightly held on the outer circumferential surface of the drying drum 76.

The solvent dryer 78 is disposed in a position facing the outer circumferential surface of the drying drum 76, and includes a plurality of halogen heaters 80, and a plurality of warm-air blow-out nozzles 82, each of which is arranged between adjacent two of the halogen heaters 80.

Each of the warm-air blow-out nozzles 82 is controlled to blow warm air at a prescribed temperature (for example, 50° C. to 70° C.) at a constant blowing rate (for example, 12 $m^3$/min) toward the recording medium 24. Each of the halogen heaters 80 is controlled to a prescribed temperature (for example, 180° C.).

With the solvent dryer 78 of the above-described configuration, water included in the ink solvent on the recording surface of the recording medium 24 held by the drying drum 76 is evaporated, and drying treatment is performed. In this case, because the drying drum 76 of the drying unit 18 is structurally separated from the image formation drum 70 of the image formation unit 16, the number of ink non-ejection events caused by drying of the head meniscus portion by thermal drying can be reduced in the inkjet heads 72M, 72K, 72C and 72Y. Further, there is a degree of freedom in setting the temperature of the drying unit 18, and the optimum drying temperature can be set.

The surface temperature of the drying drum 76 is set to 50° C. or above. By heating from the rear surface of the recording medium 24, drying is promoted and breaking of the image during fixing can be prevented. In this case, more beneficial effects are obtained if a device for causing the recording medium 24 to adhere tightly to the outer circumferential surface of the drying drum 76 is provided. As a device for causing the recording medium 24 to adhere tightly in this way, it is possible to employ various methods, such as vacuum suction, electrostatic attraction, or the like.

There are no particular restrictions on the upper limit of the surface temperature of the drying drum 76, but from the viewpoint of the safety of maintenance operations such as cleaning the ink adhering to the surface of the drying drum 76 (namely, preventing burns due to high temperature), desirably, the surface temperature of the drying drum 76 is not higher than 75° C. (and more desirably, not higher than 60° C.).

By holding the recording medium 24 in such a manner that the recording surface thereof is facing outward on the outer circumferential surface of the drying drum 76 having this composition (in other words, in a state where the recording surface of the recording medium 24 is curved in a convex shape), and drying while conveying the recording medium in rotation, it is possible to prevent the occurrence of wrinkles or floating up of the recording medium 24, and therefore drying non-uniformities caused by these phenomena can be prevented reliably.

The recording medium 24 which has been subjected to the drying treatment in the drying unit 18 is transferred from the drying drum 76 through an intermediate conveyance unit 30 to a fixing drum 84 of the fixing unit 20.

<Fixing Unit>

The fixing unit 20 includes a fixing drum (corresponding to a medium holding device) 84, a halogen heater 86, a fixing roller (corresponding to a roller member or a heating roller) 88, a parting oil supplying roller (corresponding to an oil supplying device) 89, and an inline sensor 90. The halogen heater 86, the fixing roller 88, and the inline sensor 90 are arranged in positions opposite the outer circumferential surface of the fixing drum 84 in this order from the upstream side in the rotation direction (counterclockwise direction in FIG. 1) of the fixing drum 84.

The fixing drum 84 a drum that holds the recording medium 24 on the outer circumferential surface thereof and rotationally conveys the recording medium 24. The rotation of the fixing drum 84 is driven and controlled by the motor driver 176 (see FIG. 5) described below. Similar to the treatment liquid drum 54, the fixing drum 84 is provided on the outer circumferential surface thereof with a hook-shaped holding device (gripper) 85, which can hold the recording medium 24 by gripping the leading end portion of the recording medium 24. The recording medium 24 is rotated and conveyed by rotating the fixing drum 84 in a state in which the leading end portion of the recording medium is held by the holding device 85. In this case, the recording medium 24 is conveyed so that the recording surface thereof faces outward, and the preheating by the halogen heater 86, the fixing treatment by the fixing roller 88 and the inspection by the inline sensor 90 are performed with respect to the recording surface. The fixing drum 84 may be provided with suction apertures on the outer circumferential surface thereof and connected to a suction device that performs suction from the suction apertures. As a result, the recording medium 24 can be tightly held on the outer circumferential surface of the fixing drum 84.

The halogen heater 86 is controlled to a prescribed temperature (for example, 180° C.), by which the preheating is performed with respect to the recording medium 24.

The fixing roller 88 is a roller member which applies pressure and heat to the dried ink to melt and fix the self-dispersible polymer particles in the ink so as to transform the ink into the film. More specifically, the fixing roller 88 is arranged so as to be pressed against the fixing drum 84, and a nip roller is configured between the fixing roller 88 and the fixing drum 84. As a result, the recording medium 24 is squeezed between the fixing roller 88 and the fixing drum 84, nipped under a prescribed nip pressure (for example, 0.15 MPa), and subjected to fixing treatment.

Further, the fixing roller 88 is configured by a heating roller in which a halogen lamp is incorporated in a metal pipe, for example made from aluminum, having good thermal conductivity and the rollers are controlled to a prescribed temperature (for example 60° C. to 80° C.). Where the recording medium 24 is heated with the heating roller, thermal energy not lower than a Tg temperature (glass transition temperature) of a latex included in the ink is applied and latex particles are melted. As a result, fixing is performed by penetration into the projections-recessions of the recording medium 24, the projections-recessions of the image surface are leveled out, and gloss is obtained.

The parting oil supplying roller 89 functions as a device to apply the parting oil onto the circumferential surface of the fixing roller 88. The parting oil is applied to the fixing roller 88 in order to prevent the phenomenon of the droplets of ink having been deposited on the recording medium 24 becoming attached to the fixing roller 88 (ink offset).

Figure 2:
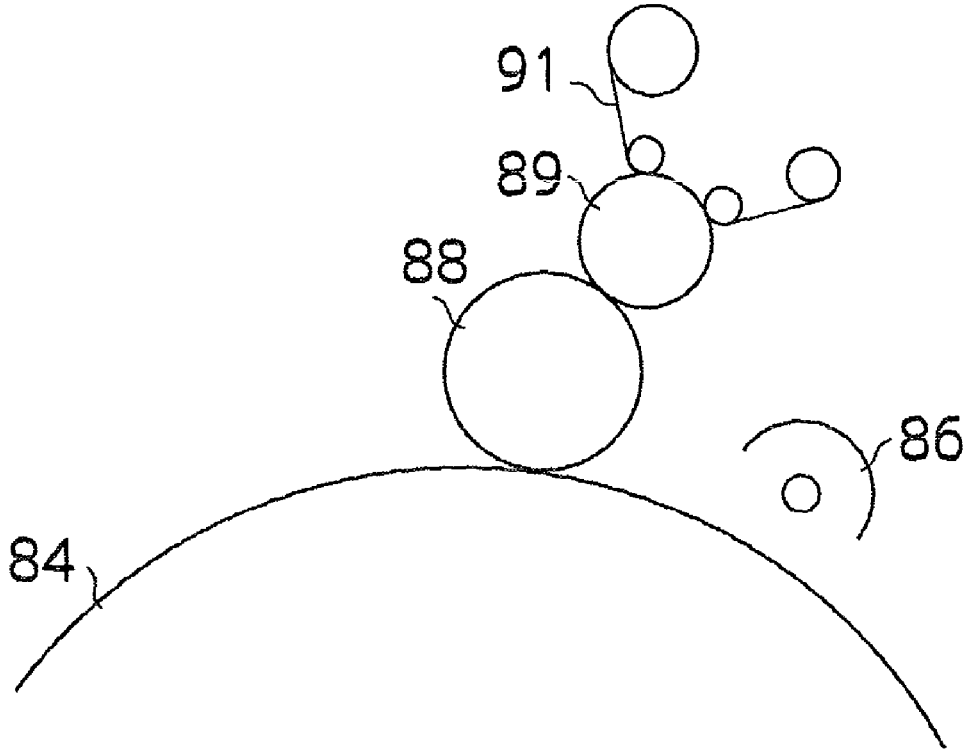
FIG. 2 is a diagram showing the composition of a device for supplying parting oil to a fixing roller according to the embodiment.

For example, as shown in FIG. 2, the parting oil supplying roller 89 supplies a prescribed amount of parting oil by means of a parting oil-impregnated web 91, and the parting oil thus supplied is applied to the fixing roller 88. The device for applying parting oil to the fixing roller 88 may employ various modes, apart from the mode described above, such as a mode using a porous roller impregnated with parting oil, a mode where oil is sprayed onto the circumferential surface of the fixing roller 88 from an oil spraying nozzle, and a mode where parting oil is applied directly by means of a parting oil-impregnated web 91 without using the parting oil supplying roller 89, or the like.

The fixing unit 20 in the embodiment shown in FIG. 1 is provided with the single fixing roller 88; however, it is possible that the fixing roller 88 has a configuration provided with a plurality of steps, depending on the thickness of image layer and Tg characteristic of latex particles. Moreover, the surface of the fixing drum 84 may be controlled to a prescribed temperature (for example 60° C.).

On the other hand, the inline sensor 90 is a measuring device which measures the check pattern, moisture amount, surface temperature, gloss, and the like of the image fixed to the recording medium 24. A CCD sensor or the like can be used for the inline sensor 90.

With the fixing unit 20 of the above-described configuration, the latex particles located within a thin image layer formed in the drying unit 18 are melted by application of pressure and heat by the fixing roller 88. Thus, the latex particles can be reliably fixed to the recording medium 24. In addition, with the fixing unit 20, the fixing drum 84 is structurally separated from other drums. Therefore, the temperature of the fixing unit 20 can be freely set separately from the image formation unit 16 and the drying unit 18.

The surface temperature of the fixing drum 84 is set to 50° C. or above. Drying is promoted by heating the recording medium 24 held on the outer circumferential surface of the fixing drum 84 from the rear surface, and therefore breaking of the image during fixing can be prevented, and furthermore, the strength of the image can be increased by the effects of the increased temperature of the image.

There are no particular restrictions on the upper limit of the surface temperature of the fixing drum 84, but desirably, it is set to 75° C. or lower (and more desirably, 60° C. or lower), from the viewpoint of maintenance characteristics.

Furthermore, it is desirable to achieve a state where the moisture in the image has been evaporated off and the high-boiling-point organic solvent has been reduced to a suitable concentration in the image (in other words, a state where the high-boiling-point organic solvent in the image remains at a rate of 4% or more of the ink droplet deposition volume), since the image deforms more readily with respect to the surface of the fixing roller (heating and pressing member) 88 during fixing, while having sufficient strength to avoid breaking of the image. Moreover, if a binder component is included in the image, then similarly to preheating the image, the image can be expected to follow the surface of the fixing roller 88, and fixing non-uniformities can be prevented yet more effectively.

Here, a "state where the high-boiling-point organic solvent in the image remains at a rate of 4% or more of the ink droplet deposition volume" means that the ratio of the remaining amount of high-boiling-point organic solvent in the image present on the surface of the recording medium at the time of the fixing process with respect to the ink droplet deposition volume is not less than 4%.

By holding the recording medium 24 with the recording surface thereof facing outward on the outer circumferential surface of the fixing drum 84 having this composition (in other words, in a state where the recording surface of the recording medium 24 is curved in a convex shape), and heating and pressing to fix the image while conveying the recording medium in rotation, then even in a state where the moisture is not dried off completely and some degree of cockling is liable to occur, this cockling can be rectified.

Furthermore, since fixing can be carried out by the fixing roller (heating and pressing member) 88 in a state where the surface of the recording medium 24 is pulled and stretched against the force which seeks to create indentations in the surface (recording surface) of the recording medium 24 due to the swelling of the pulp fibers, and hence the indentations caused by cockling have been alleviated and flattened, then it is possible to prevent the occurrence of fixing non-uniformities caused by cockling.

<Discharge Unit>

As shown in FIG. 1, the discharge unit 22 is provided after the fixing unit 20. The discharge unit 22 includes a discharge tray 92, and a transfer drum 94, a conveying belt 96, and a tension roller 98 are provided between the discharge tray 92 and the fixing drum 84 of the fixing unit 20 so as to face the discharge tray 92 and the fixing drum 84. The recording medium 24 is fed by the transfer drum 94 onto the conveying belt 96 and discharged onto the discharge tray 92.

If carrying out double-side printing, the recording medium 24 having completed single-side printing is returned to the paper feed unit 12 from the discharge tray 92, and the recording medium 24 is turned over and supplied again. The device for conveying the recording medium 24 from the discharge unit 22 to the paper feed unit 12 and the device for turning over the recording surface may use a mode employing an automatic conveyance mechanism and an automatic inverting mechanism.

<Structure of Ink Heads>

Next, the structure of the inkjet heads is described. The heads 72M, 72K, 72C and 72Y for the respective colored inks have the same structure, and a reference numeral 150 is hereinafter designated to any of the inkjet heads (hereinafter also referred to simply as the heads).

Figure 3A:
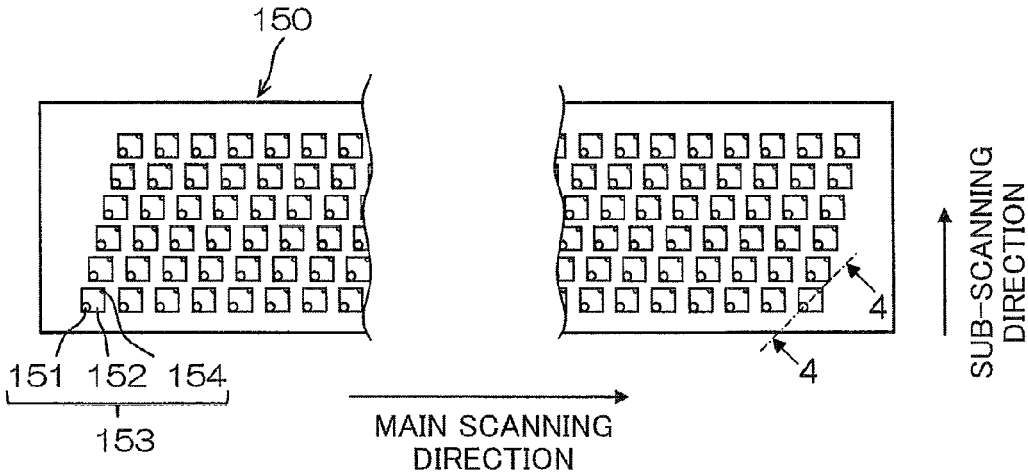
FIGS. 3A to 3C are plan view perspective diagrams showing examples of the composition of an inkjet head.
Figure 3B:
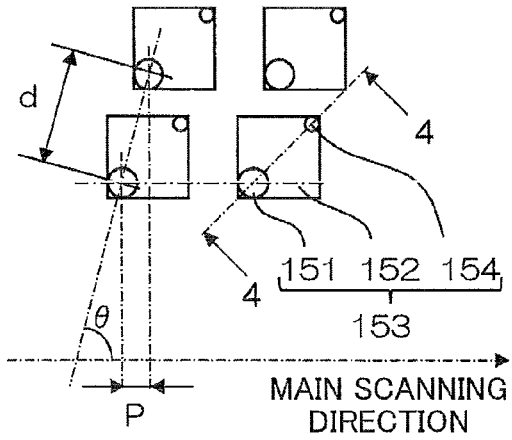
Figure 3C:
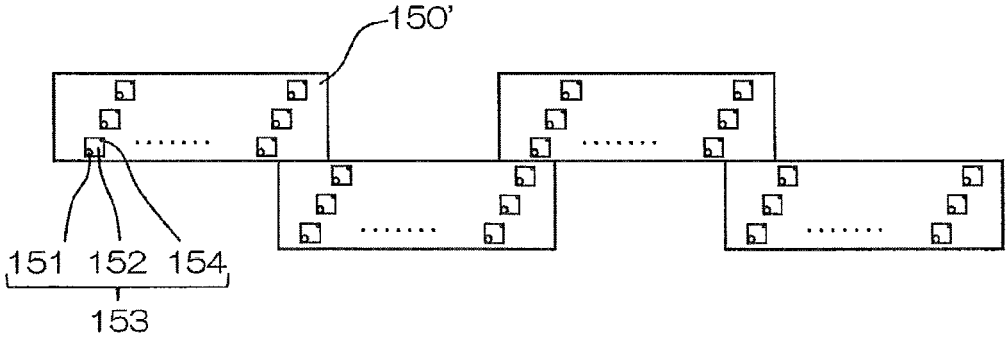
Figure 4:
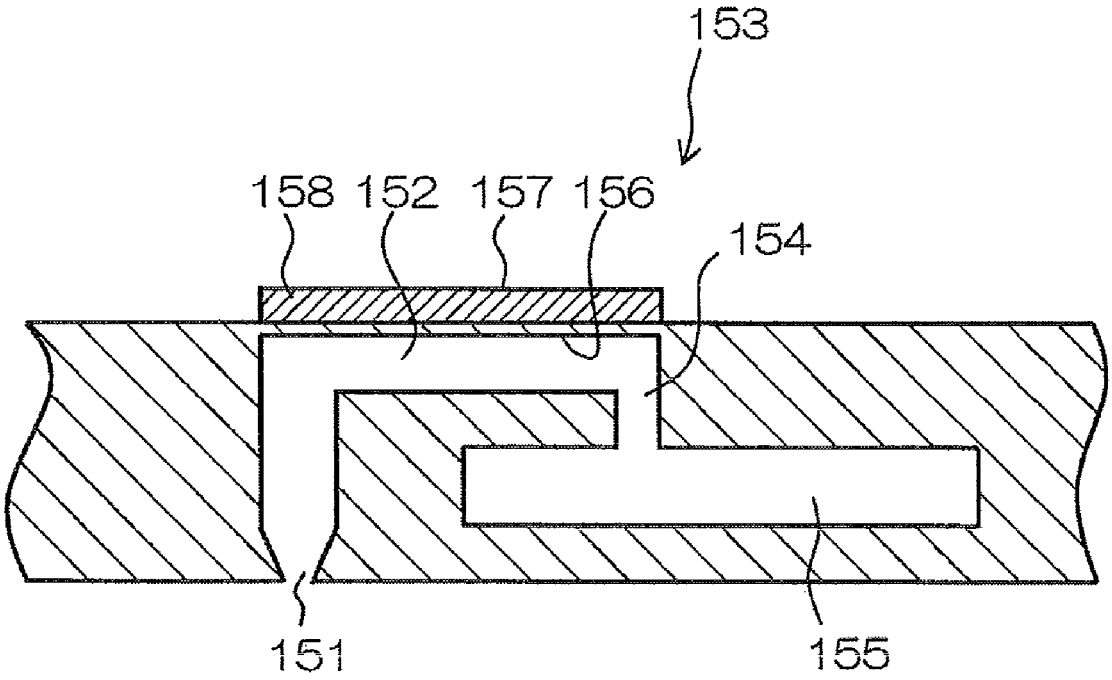
FIG. 4 is a cross-sectional view along line 4-4 in FIGS. 3A and 3B, showing the internal composition of an ink chamber unit.

FIG. 3A is a perspective plan view showing an embodiment of the configuration of the head 150, FIG. 3B is an enlarged view of a portion thereof, and FIG. 3C is a perspective plan view showing another example of the configuration of the head 150. FIG. 4 is a cross-sectional view taken along the line 4-4 in FIGS. 3A and 3B, showing the inner structure of an ink chamber unit in the head 50.

The nozzle pitch in the head 150 should be minimized in order to maximize the density of the dots printed on the surface of the recording medium 24. As shown in FIGS. 3A and 3B, the head 150 according to the present embodiment has a structure in which a plurality of ink chamber units (i.e., droplet ejection units serving as recording units) 153, each having a nozzle 151 forming an ink ejection aperture, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head 150 (the main scanning direction: the direction perpendicular to the conveyance direction of the recording medium 24) is reduced and high nozzle density is achieved.

The mode of forming one or more nozzle rows through a length corresponding to the entire width of the recording medium 24 in the main scanning direction substantially perpendicular to the conveyance direction of the recording medium 24 (the sub-scanning direction) is not limited to the embodiment described above. For example, instead of the configuration in FIG. 3A, as shown in FIG. 3C, a line head having nozzle rows of a length corresponding to the entire width of the recording medium 24 can be formed by arranging and combining, in a staggered matrix, short head blocks 150' having a plurality of nozzles 151 arrayed in a two-dimensional fashion. Furthermore, although not shown in the drawings, it is also possible to compose a line head by arranging short heads in one row.

The planar shape of the pressure chamber 152 provided for each nozzle 151 is substantially a square, and the nozzle 151 and an ink supply port 154 are disposed in both corners on a diagonal line of the square. The shape of the pressure chamber 152 is not limited to that of the present embodiment, and a variety of planar shapes, for example, a polygon such as a rectangle (rhomb, rectangle, etc.), a pentagon and a heptagon, a circle, and an ellipse can be employed.

Each pressure chamber 152 is connected to a common channel 155 through the supply port 154. The common channel 155 is connected to an ink tank (not shown), which is a base tank for supplying ink, and the ink supplied from the ink tank is delivered through the common flow channel 155 to the pressure chambers 152.

A piezoelectric element 158 provided with an individual electrode 157 is bonded to a diaphragm 156, which forms a face (the upper face in FIG. 4) of the pressure chamber 152 and also serves as a common electrode. A mode is also possible in which a diaphragm is formed by a non-conductive material, such as resin, and in this case, a common electrode layer made of a conductive material, such as metal, is formed on the surface of the diaphragm member.

When a drive voltage is applied to the individual electrode 157, the piezoelectric element 158 is deformed, the volume of the pressure chamber 104 is thereby changed, and the ink is ejected from the nozzle 151 by the variation in pressure that follows the variation in volume. When the piezoelectric element 158 returns to the original state after the ink has been ejected, the pressure chamber 152 is refilled with new ink from the common channel 155 through the supply port 154.

The present embodiment applies the piezoelectric elements 158 as ejection power generation devices to eject the ink from the nozzles 151 arranged in the head 150; however, instead, a thermal system that has heaters within the pressure chambers 152 to eject the ink using the pressure resulting from film boiling by the heat of the heaters can be applied.

As shown in FIG. 3B, the high-density nozzle head according to the present embodiment is achieved by arranging the plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the ink chamber units 153 are arranged at a uniform pitch d in line with a direction forming the angle of θ with respect to the main scanning direction, the pitch P of the nozzles projected so as to align in the main scanning direction is d×cos θ, and hence the nozzles 151 can be regarded to be equivalent to those arranged linearly at a fixed pitch P along the main scanning direction.

In implementing the present invention, the mode of arrangement of the nozzles 151 in the head 150 is not limited in particular, and various difference nozzle arrangement structures can be employed. For example, instead of a matrix arrangement as described in FIGS. 3A and 3B, it is also possible to use a single linear arrangement, a V-shaped nozzle arrangement, or an undulating nozzle arrangement, such as zigzag configuration (W-shape arrangement), which repeats units of V-shaped nozzle arrangements.

According to the composition in which the full line heads having the nozzle rows covering the full width of the image forming region of the recording medium 24 are provided respectively for the colors of ink as described above, it is possible to record an image on the image forming region of the recording medium 24 by conveying the recording medium 24 with the image formation drum 70 at a specific speed while performing just one operation of moving the recording medium 24 and the ink heads 72M, 72K, 72C and 72Y relatively with respect to each other in the conveyance direction (the sub-scanning direction) (in other words, by one sub-scanning action). This single-pass type image formation with such the full line type (page-wide) heads can achieve a higher printing speed compared to a case of a multi-pass type image formation with a serial (shuttle) type of head which moves back and forth reciprocally in the direction (the main scanning direction) perpendicular to the conveyance direction of the recording medium (the sub-scanning direction), and hence it is possible to improve the print productivity.

The scope of application of the present invention is not limited to a printing system based on the line type of head, and it is also possible to adopt a serial system where a short head that is shorter than the breadthways dimension of the recording medium 24 is moved in the breadthways direction (main scanning direction) of the recording medium 24, thereby performing printing in the breadthways direction, and when one printing action in the breadthways direction has been completed, the recording medium 24 is moved through a prescribed amount in the sub-scanning direction perpendicular to the breadthways direction, printing in the breadthways direction of the recording medium 24 is carried out in the next printing region, and by repeating this sequence, printing is performed over the whole surface of the printing region of the recording medium 24.

<Description of Control System>

Figure 5:
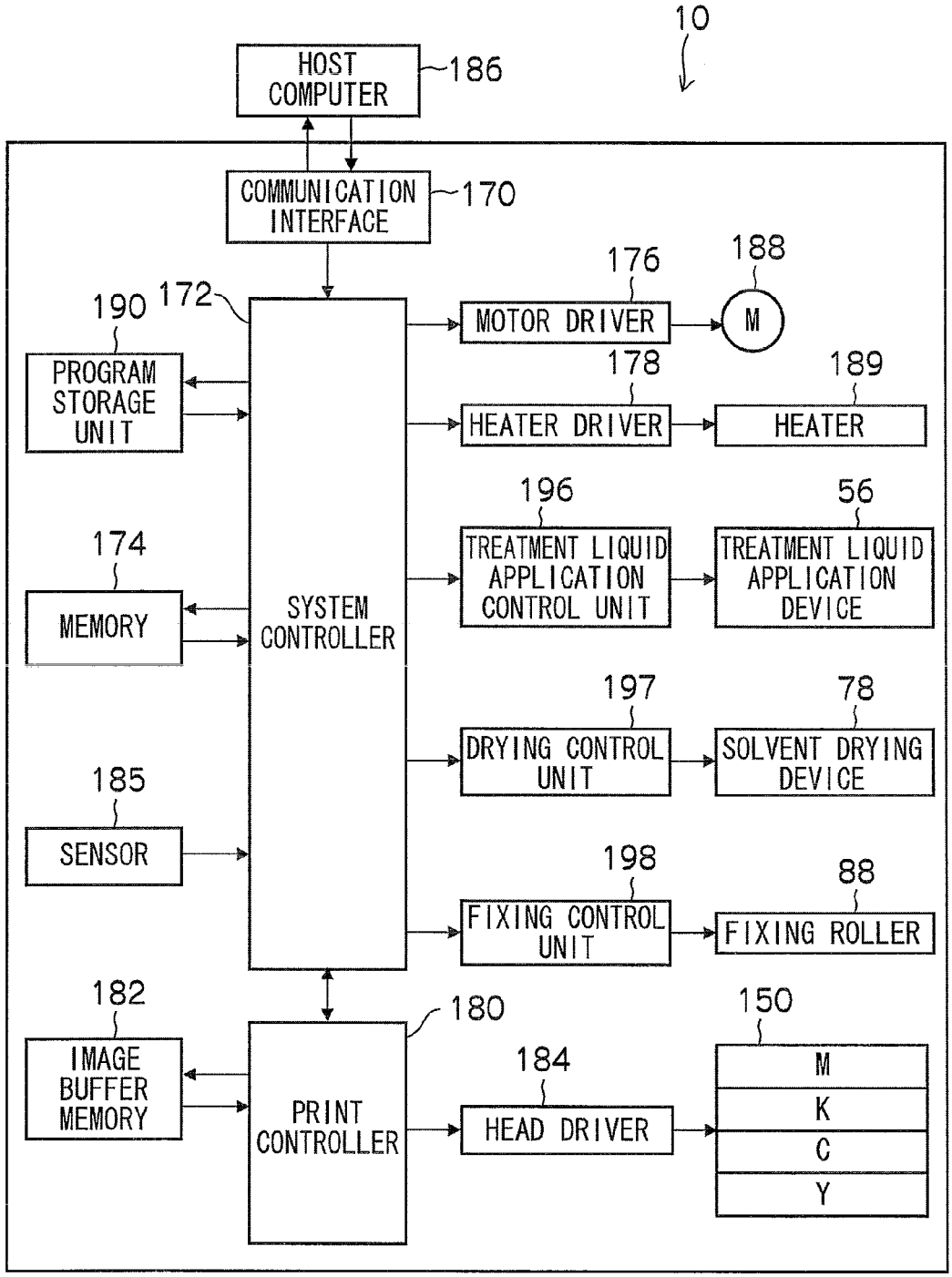
FIG. 5 is a principal block diagram illustrating the system configuration of the inkjet recording apparatus in FIG. 1.

FIG. 5 is a block diagram of the main portion of a system configuration of the inkjet recording apparatus 10. The inkjet recording apparatus 10 includes a communication interface 170, a system controller 172, a memory 174, a motor driver 176, a heater driver 178, a printing control unit 180, an image buffer memory 182, a head driver 184, a sensor 185, a program storage unit 190, a treatment liquid application control unit 196, a drying control unit 197, and a fixing control unit 198.

The communication interface 170 is an interface unit, which functions as an image input device that receives image data sent from a host computer 186. A serial interface such as USB (Universal Serial Bus), IEEE 1394, Ethernet, and a wireless network, or a parallel interface such as Centronix can be applied as the communication interface 170. A buffer memory (not shown) may be installed in the part of the interface to increase the communication speed. The image data sent from the host computer 186 are introduced into the inkjet recording apparatus 10 through the communication interface 170 and temporarily stored in the memory 174.

The memory 174 is a storage device that temporarily stores the images inputted through the communication interface 170 and reads/writes the data via the system controller 172. The memory 174 is not limited to a memory composed of semiconductor elements and may use a magnetic medium such as a hard disk.

The system controller 172 includes a central processing unit (CPU) and a peripheral circuitry thereof, functions as a control device that controls the entire inkjet recording apparatus 10 according to a predetermined program, and also functions as an operational unit that performs various computations. Thus, the system controller 172 controls various units such as the communication interface 170, the memory 174, the motor driver 176, the heater driver 178, the treatment liquid application control unit 196, the drying control unit 197 and the fixing control unit 198, performs communication control with the host computer 180, performs read/write control of the memory 174, and also generates control signals for controlling the various units.

Programs that are executed by the CPU of the system controller 172 and various data necessary for performing the control are stored in the memory 174. The memory 174 may be a read-only storage device or may be a writable storage device such as EEPROM. The memory 174 can be also used as a region for temporary storing image data, a program expansion region, and a computational operation region of the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. The program storage unit 190 may be provided with an external interface, and a memory card or PC card may also be used. Naturally, a plurality of these storage media may also be provided. The program storage unit 190 may also be combined with a storage device for storing operational parameters, and the like (not shown).

The motor driver 176 drives the motor 188 in accordance with commands from the system controller 172. In FIG. 5, the plurality of motors disposed in the respective sections of the inkjet recording apparatus 10 are represented by the reference numeral 188. For example, the motor 188 shown in FIG. 5 includes the motors that drive the paper transfer drum 52, the treatment liquid drum 54, the image formation drum 70, the drying drum 76, the fixing drum 84 and the transfer drum 94 shown in FIG. 1, and the motors that drive the drums in the first, second and third intermediate conveyance units 26, 28 and 30.

The heater driver 178 is a driver that drives the heater 189 in accordance with commands from the system controller 172. In FIG. 5, the plurality of heaters disposed in the inkjet recording apparatus 10 are represented by the reference numeral 189. For example, the heater 189 shown in FIG. 5 includes the halogen heaters 80 in the solvent dryer 78 arranged in the drying unit 18 shown in FIG. 1, and the heaters for heating the circumferential surfaces of the drying drum 76 and the fixing drum 84 shown in FIG. 1.

The treatment liquid application control unit 196, the drying control unit 197 and the fixing control unit 198 control the operations of the treatment liquid application device 56, the solvent dryer 78 and the fixing roller 88, respectively, in accordance with commands from the system controller 172.

The printing control unit 180 has a signal processing function for performing a variety of processing and correction operations for generating signals for print control from the image data within the memory 174 according to control of the system controller 172, and supplies the generated printing data (dot data) to the head driver 184. The required signal processing is implemented in the printing control unit 180, and the ejection amount and ejection timing of droplets in the heads 150 are controlled through the head driver 184 based on the image data. As a result, the desired dot size and dot arrangement are realized.

The printing control unit 180 is provided with the image buffer memory 182, and data such as image data or parameters are temporarily stored in the image buffer memory 182 during image data processing in the printing control unit 180. A mode is also possible in which the printing control unit 180 and the system controller 172 are integrated and configured by one processor.

The head driver 184 generates drive signals for driving the piezoelectric elements 158 of the heads 150, on the basis of the dot data supplied from the print controller 180, and drives the piezoelectric elements 158 by applying the generated drive signals to the piezoelectric elements 158. A feedback control system for maintaining constant drive conditions in the recording heads 150 may be included in the head driver 184 shown in FIG. 5.

The sensor 185 represents the sensors disposed in the respective sections of the inkjet recording apparatus 10. For example, the sensor 185 includes the inline sensor 90 shown in FIG. 1, temperature sensors, position determination sensors, pressure sensors, and paper type and size determination sensors. The output signals of the sensor 185 are sent to the system controller 172, and the system controller 172 controls the respective sections of the inkjet recording apparatus 10 by sending the command signals to the respective sections in accordance with the output signals of the sensor 185.

In the case of the present embodiment, information about the size of the recording medium 24 used for printing is input to the system controller 172 and the supply of the cleaning sheet is controlled accordingly. In other words, the system controller 172 functions as a cleaning sheet supply control device.

The device for acquiring information on the size of the recording medium 24 may employ a mode in which size information is acquired automatically from a paper size determination sensor or from a paper tray selection signal, or the like, or a composition may be adopted in which size information is entered by a user operating a prescribed input apparatus (user interface), or the like.

<Method of Preventing Adherence of Parting Oil to Recording Medium>

If, as described previously, a sheet-shaped recording medium 24 that has completed image formation by the inkjet head is wrapped about and held on a fixing drum 84, and fixing is carried out by pressing the fixing roller 88 against the image surface while causing the fixing drum 84 to rotate, then the parting oil applied to the surface of the fixing roller 88 adheres to the portion of the fixing drum 84 where no recording medium paper has passed.

Consequently, if the size of the recording medium used for printing is changed and a recording medium having a larger size than the size before change is used, then a problem is presented by the parting oil which is adhering (remaining) on the portion of the fixing drum 84 where no recording medium has passed when using a recording medium of smaller size before change.

If it is supposed that an image is then formed on a recording medium by supplying recording medium of the large size in this state, then the parting oil on the fixing drum 84 adheres to the rear surface of the recording medium. Therefore, in particular when carrying out double-side printing onto the recording medium, the treatment liquid and ink are repelled due to the effects of the oil adhering to the recording medium, and there is a problem in that it is not possible to form a good image.

In response to this problem, in the present embodiment, if the size of the recording medium is changed to a large size, then before carrying out printing of this large size, the parting oil on the fixing drum 84 is removed by passing a cleaning sheet. The cleaning sheet used is of equal size or larger than the recording medium of large size after the size change, and desirably has a width equal to or greater than the width of the fixing roller 88.

Consequently, it is possible to prevent parting oil from adhering to the rear surface of a recording medium of large size which is used to print a desired image, and satisfactory double-side printing can be carried out.

<Parting Oil Removal Characteristics by Cleaning Sheet and Sheet Passage Characteristics>

Table 1 shows experimental results of investigating the relationship between the permeability of the cleaning sheet (which is evaluated here as the permeability coefficient according to Bristow's method with respect to water) and the parting oil removal characteristics and sheet passage characteristics. Here, the experiments were carried out with the cleaning sheets which had different Bristow permeability coefficients of 0.05 ml/($m^2$·$msec^{1/2}$) to 0.60 ml/($m^2$·$msec^{1/2}$) and had the same surface roughness (center-line average roughness: Ra) of 0.20 μm at the surfaces thereof on the side making contact with the fixing drum 84.

TABLE 1

| Bristow permeability coefficient (ml/($m^2 \times \sqrt{ms}$)) | Surface roughness (μm) | Parting oil removal characteristics | Sheet passage characteristics |
|---|---|---|---|
| 0.05 | 0.20 | Poor | Good |
| 0.10 | 0.20 | Fair | Good |
| 0.15 | 0.20 | Fair | Good |
| 0.20 | 0.20 | Good | Good |
| 0.25 | 0.20 | Good | Good |
| 0.30 | 0.20 | Good | Good |
| 0.40 | 0.20 | Good | Good |
| 0.50 | 0.20 | Good | Good |
| 0.55 | 0.20 | Good | Poor |
| 0.60 | 0.20 | Good | Very Poor |

Table 2 shows experimental results of investigating the relationship between the surface roughness of the cleaning sheet and the parting oil removal characteristics and sheet passage characteristics. Here, the experiments were carried out with the cleaning sheets which had different surface roughnesses (center-line average roughness: Ra) of 0.05 μm to 2.50 μm at the surfaces thereof on the side making contact with the fixing drum 84 and had the same Bristow permeability coefficient of 0.30 ml/($m^2$·$msec^{1/2}$).

TABLE 2

| Surface roughness (μm) | Bristow permeability coefficient (ml/($m^2 \times \sqrt{ms}$)) | Parting oil removal characteristics | Sheet passage characteristics |
|---|---|---|---|
| 0.05 | 0.30 | Good | Very Poor |
| 0.10 | 0.30 | Good | Poor |
| 0.20 | 0.30 | Good | Good |
| 0.50 | 0.30 | Good | Good |
| 1.00 | 0.30 | Good | Good |
| 1.20 | 0.30 | Fair | Good |
| 1.50 | 0.30 | Fair | Good |
| 2.00 | 0.30 | Fair | Good |
| 2.50 | 0.30 | Poor | Good |

The parting oil removal characteristics in the present experiments were evaluated by passing a recording medium after passing five cleaning sheets, and then assessing the coating properties of undercoating liquid (treatment liquid) which was applied to the rear surface of the recording medium.

In respect of the parting oil removal characteristics in Tables 1 and 2, "Good" means that it was possible to satisfactorily remove parting oil by passing five sheets. "Fair" means that removal of parting oil was unsatisfactory by passing five sheets, but it was possible to satisfactorily remove parting oil by passing ten sheets. "Poor" means that removal of parting oil was unsatisfactory even after passing ten sheets.

In respect of the sheet passage characteristics in Tables 1 and 2, "Good" means that the sheet could be passed satisfactorily. "Poor" means that a sheet passage defect (breakage of the cleaning sheet, or the like) occurred with a probability of around 1/5. "Very Poor" means that a sheet passage defect occurred on virtually every occasion.

In the present experiments, the Bristow permeability coefficient with respect to water was used as an index for readily investigating the permeability of the cleaning sheet. The greater the Bristow permeability coefficient, the more liquid is absorbed, and if this value is small, then the capability for absorbing liquid (in other words, the parting oil removal capability) is low.

However, if the value of the Bristow permeability coefficient is too large, then an excessive amount of liquid is absorbed and the cleaning sheet sticks to the fixing drum 84. Further, the more liable the liquid is to seep into the sheet, the greater the distance between the fibers and therefore the more fragile the sheet tends to become.

Consequently, if it is sought to convey the cleaning sheet by gripping with the gripper 85, then if the sheet has absorbed a large amount of oil and has stuck to the fixing drum 84, the sheet becomes difficult to remove from the fixing drum 84, and since the cleaning sheet becomes fragile, it may tear. In this way, if the value of the Bristow permeability coefficient is too large, then the sheet passage characteristics become worse.

According to Table 1, in relation to the parting oil removal characteristics, the Bristow permeation coefficient of 0.10 ml/($m^2$·$msec^{1/2}$) or above is desirable, and 0.20 ml/($m^2$·$msec^{1/2}$) or above is more desirable.

If the Bristow permeability coefficient is 0.20 ml/($m^2$·$msec^{1/2}$) or above, then it was possible to satisfactorily apply an undercoating liquid (treatment liquid) to the rear surface of the recording medium, by passing five sheets of cleaning sheet.

Furthermore, in relation to the sheet passage characteristics, desirably, the Bristow permeability coefficient is 0.50 ml/($m^2$·$msec^{1/2}$) or lower. If the Bristow permeability coefficient is greater than 0.50 ml/($m^2$·$msec^{1/2}$), the cleaning sheet absorbs an excessive amount of parting oil, and sheet passage defects occurs, for instance, the sheet becomes more difficult to separate from the pressure drum (fixing drum 84), and the sheet tears, and the like.

Consequently, in order to achieve both good oil removal characteristics and good sheet passage characteristics, it is desirable to use a cleaning sheet having the Bristow permeability coefficient not less than 0.1 ml/($m^2$·$msec^{1/2}$) and not more than 0.5 ml/($m^2$·$msec^{1/2}$), and more desirably, not less than 0.2 ml/($m^2$·$msec^{1/2}$) and not more than 0.5 ml/($m^2$·$msec^{1/2}$).

On the other hand, in respect of the surface roughness of the cleaning sheet, the smaller the value of the surface roughness, the greater the contact surface area with the pressure drum (fixing drum 84) and the better the absorption of the oil, and if the value of the surface roughness is large, then the liquid absorbing capability (in other words, the parting oil removal capability) is low.

However, if the value of the surface roughness is too small, then an excessive amount of liquid is absorbed and the cleaning sheet sticks to the fixing drum 84. In other words, the greater the adherence characteristics of the sheet and the more liable liquid is to seep into the sheet, the more difficult the sheet becomes to separate from the fixing drum 84.

Consequently, if it is sought to convey the cleaning sheet by gripping with the gripper 85, then if the sheet has absorbed a large amount of oil and has stuck to the fixing drum 84, the sheet becomes difficult to remove from the fixing drum 84, and since the cleaning sheet has absorbed oil and the sheet has become fragile, it may tear during conveyance. In this way, if the value of the surface roughness is too small, then sheet passage characteristics become worse.

According to Table 2, in relation to the parting oil removal characteristics, the surface roughness is desirably 2.0 μm or lower and more desirably, 1.0 μm or lower in terms of the center-line average roughness (Ra).

If the surface roughness (center-line average roughness: Ra) was 1.0 μm or lower, then it was possible to satisfactorily apply an undercoating liquid (treatment liquid) to the rear surface of the recording medium, by passing five sheets of cleaning sheet.

Furthermore, in relation to sheet passage characteristics, desirably, the surface roughness (center-line average roughness: Ra) is 0.20 μm or above. If the surface roughness (center-line average roughness: Ra) is less than 0.20 μm, then the cleaning sheet becomes more difficult to separate from the pressure drum (fixing drum 84) and sheet passage defects occur.

Consequently, in order to achieve both good oil removal characteristics and good sheet passage characteristics, it is desirable to use a cleaning sheet having the surface roughness (center-line average roughness: Ra) not less than 0.20 μm and not more than 2.00 μm, and more desirably, not less than 0.20 μm and not more than 1.00 μm.

Figure 6:
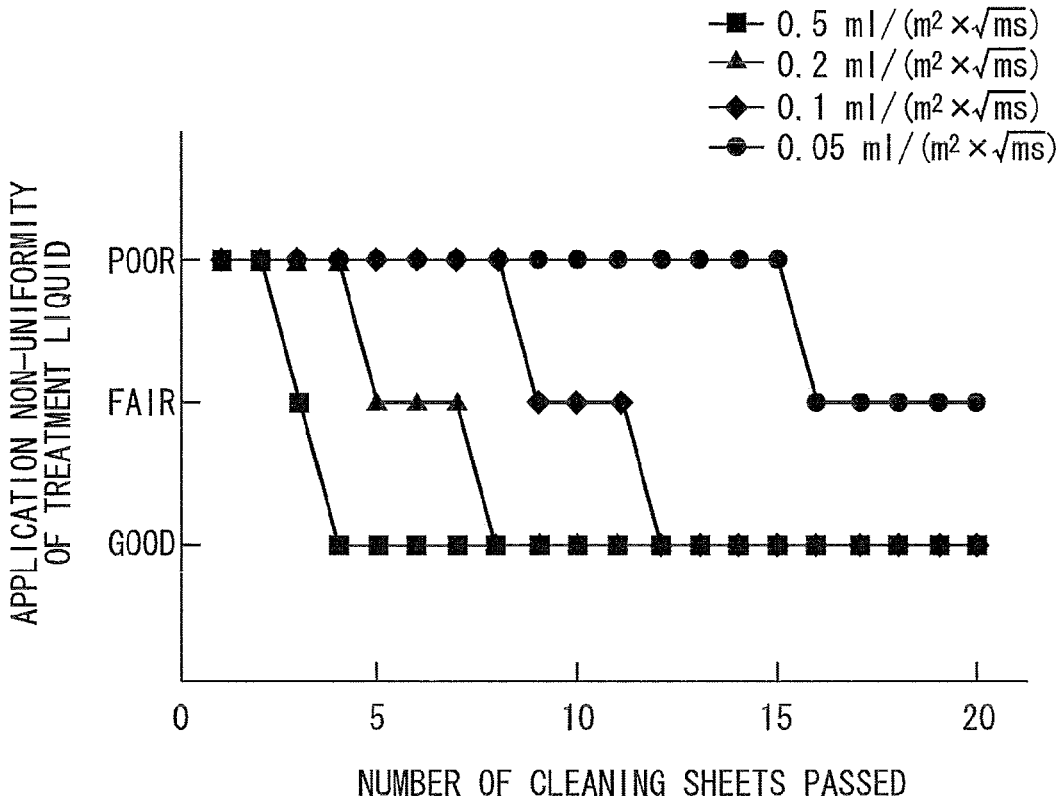
FIG. 6 is a graph showing the relationship between the number of cleaning sheets passed and the application non-uniformity of the treatment liquid.
Figure 7:
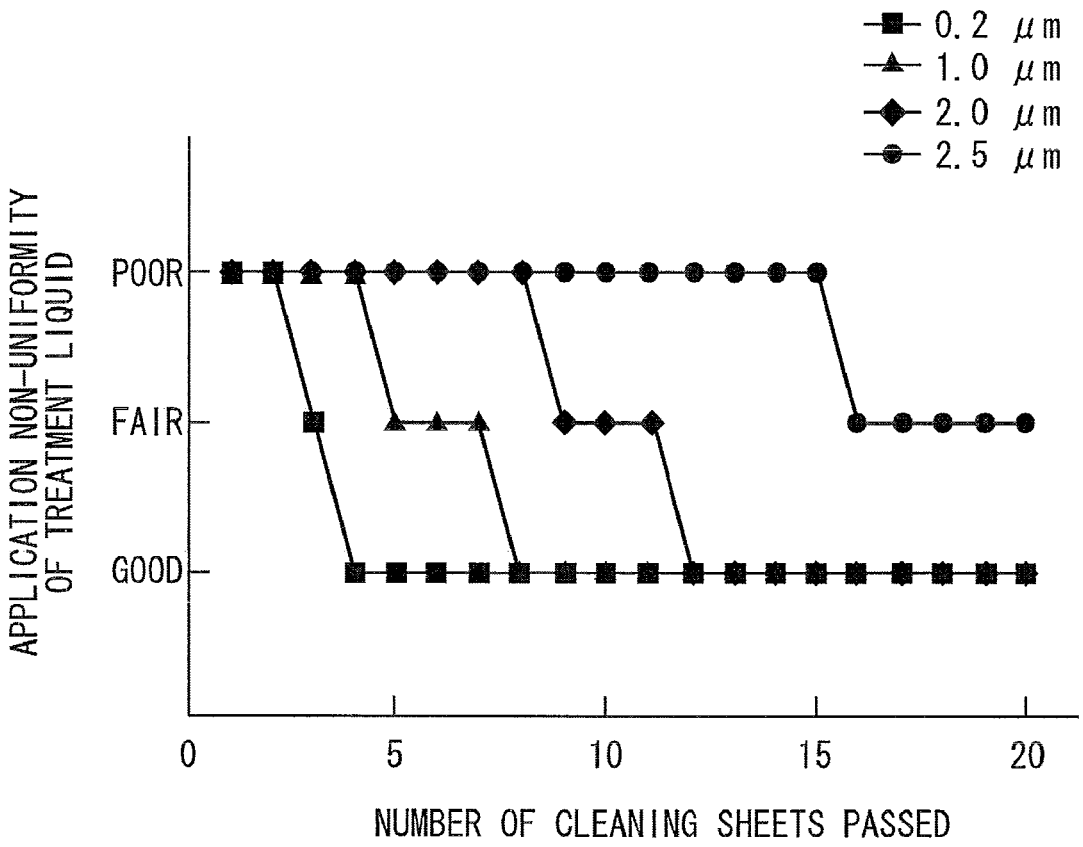
FIG. 7 is a graph showing the relationship between the number of cleaning sheets passed and the application non-uniformity of the treatment liquid.

FIGS. 6 and 7 are graphs showing experimental results of investigating the relationships between the number of cleaning sheets passed and application non-uniformities of the treatment liquid.

The horizontal axis represents the number of sheets passed, and the vertical axis represents the evaluation of application non-uniformities of the treatment liquid (in other words, parting oil removal characteristics). "Good" means that there are no application non-uniformities and that the treatment liquid is satisfactorily applied. "Fair" means that there is some application non-uniformity, but of a tolerable level. "Poor" means that the application non-uniformity is of an unsatisfactory level.

FIG. 6 shows the results of evaluating the number of sheets passed and the application non-uniformity of the treatment liquid, for a plurality of different cleaning sheets having different Bristow permeability coefficient values (herein, four types of sheet). According to FIG. 6, the higher the Bristow permeability coefficient, the greater the capability of achieving a tolerable level of application non-uniformity with a small number of passed sheets.

FIG. 7 shows the results of evaluating the number of sheets passed and the application non-uniformity of the treatment liquid, for a plurality of different cleaning sheets having different surface roughness (center-line average roughness: Ra) (herein, four types of sheet). According to FIG. 7, the smaller the surface roughness value, the greater the capability of achieving a tolerable level of application non-uniformity with a small number of passed sheets.

<Control of Number of Passed Cleaning Sheets>

The amount of parting oil adhering to the fixing drum 84 has a correlation with the number of sheets of recording medium of small size printed before the change in recording medium size, and the paper passage time. More specifically, the greater the number of printed sheets, the greater the amount of parting oil adhering to the fixing drum 84, and the longer the paper passage time, the greater the amount of parting oil adhering to the fixing drum 84 tends to become; upon exceeding a certain number of sheets (time), the amount of adhering oil becomes saturated.

Consequently, a desirable mode is one where the number of cleaning sheets passed is controlled in accordance with the number of sheets of recording medium of small size which are printed before the change of size of recording medium and/or in accordance with the paper passage time. For example, the relationship between the number of sheets printed and the amount of parting oil adhering is experimentally investigated, and a table of the number of cleaning sheets that need to be passed in order to remove respective amounts of adhering oil is stored. If the recording medium is changed to a large size, the number of cleaning sheets to be passed is decided on the basis of the number of sheets of recording medium of small size printed before the size change, by referring to the table.

Similarly, it is also possible to experimentally investigate the relationship between the paper passage time and the amount of parting oil adhering, or the relationship between the combination of the number of sheets printed and the paper passage time, and the amount of parting oil adhering, in such a manner that the number of cleaning sheets to be passed is decided by referring to the table on the basis of the paper passage time of recording medium of small size before the change of size or on the basis of a combination of the number of sheets printed and the paper passage time.

According to the inkjet recording apparatus 10 according to the above-described embodiment of the present invention, adhesion of parting oil onto the rear surface of the recording medium is prevented by passing the cleaning sheet to remove the parting oil on the fixing drum 84, before changing the recording medium size from small size to large size. Therefore, application non-uniformities of the treatment liquid onto the rear surface are improved and it is possible to achieve good double-side printing.

<Ink>

The ink used in the present embodiment is aqueous pigment ink that contains the following materials insoluble to the solvent (water): pigment particles as the coloring material, and polymer particles.

It is desirable that the concentration of the solvent-insoluble materials in the ink is not less than 1 wt % and not more than 20 wt %, taking account of the fact that the viscosity of the ink suitable for ejection is 20 mPa·s or lower. It is more desirable that the concentration of the pigment in the ink is not less than 4 wt %, in order to obtain good optical density in the image.

It is desirable that the surface tension of the ink is not less than 20 mN/m and not more than 40 mN/m, taking account of ejection stability in the ink ejection head.

The coloring material in the ink may be pigment or a combination of pigment and dye. From the viewpoint of the aggregating characteristics when the ink comes into contact with the treatment liquid, a dispersed pigment in the ink is desirable for more effective aggregation. Desirable pigments include: a pigment dispersed by a dispersant, a self-dispersing pigment, a pigment in which the pigment particle is coated with a resin (hereinafter referred to as "microcapsule pigment"), and a polymer grafted pigment. Moreover, from the viewpoint of the aggregating characteristics of the coloring material, it is more desirable that the coloring material is modified with a carboxyl group having a low degree of disassociation.

It is desirable in the present embodiment that the colored ink liquid contains polymer particles that do not contain any colorant, as a component for reacting with the treatment liquid. The polymer particles can improve the image quality by strengthening the ink viscosity raising action and the aggregating action through reaction with the treatment liquid. In particular, a highly stable ink can be obtained by adding anionic polymer particles to the ink.

By using the ink containing the polymer particles that produce the viscosity raising action and the aggregating action through reaction with the treatment liquid, it is possible to increase the quality of the image, and at the same time, depending on the type of polymer particles, the polymer particles may form a film on the recording medium, and therefore beneficial effects can be obtained in improving the wear resistance and the waterproofing characteristics of the image.

The method of dispersing the polymer particles in the ink is not limited to adding an emulsion of the polymer particles to the ink, and the resin may also be dissolved, or included in the form of a colloidal dispersion, in the ink.

The polymer particles may be dispersed by using an emulsifier, or the polymer particles may be dispersed without using any emulsifier. For the emulsifier, a surface active agent of low molecular weight is generally used, and it is also possible to use a surface active agent of high molecular weight. It is also desirable to use a capsule type of polymer particles having an outer shell composed of acrylic acid, methacrylic acid, or the like (core-shell type of polymer particles in which the composition is different between the core portion and the outer shell portion).

Examples of the resin component added as the resin particles to the ink include: an acrylic resin, a vinyl acetate resin, a styrene-butadiene resin, a vinyl chloride resin, an acrylstyrene resin, a butadiene resin, and a styrene resin.

In order to make the polymer particles have high speed aggregation characteristics, it is desirable that the polymer particles contain a carboxylic acid group having a low degree of disassociation. Since the carboxylic acid group is readily affected by change of pH, then the polymer particles containing the carboxylic acid group easily change the state of the dispersion and have high aggregation characteristics.

The change in the dispersion state of the polymer particles caused by change in the pH can be adjusted by means of the component ratio of the polymer particle having a carboxylic acid group, such as ester acrylate, or the like, and it can also be adjusted by means of an anionic surfactant which is used as a dispersant.

Desirably, the resin constituting the polymer particles is a polymer that has both of a hydrophilic part and a hydrophobic part. By incorporating a hydrophobic part, the hydrophobic part is oriented toward to the inner side of the polymer particle, and the hydrophilic part is oriented efficiently toward the outer side, thereby having the effect of further increasing the change in the dispersion state caused by change in the pH of the liquid. Therefore, aggregation can be performed more efficiently.

Moreover, two or more types of polymer particles may be used in combination in the ink.

Examples of the pH adjuster added to the ink in the present embodiment include an organic base and an inorganic alkali base, as a neutralizing agent. In order to improve storage stability of the ink for inkjet recording, the pH adjuster is desirably added in such a manner that the ink for inkjet recording has the pH of 6 through 10.

It is desirable in the present embodiment that the ink contains a water-soluble organic solvent, from the viewpoint of preventing nozzle blockages in the ejection head due to drying. Examples of the water-soluble organic solvent include a wetting agent and a penetrating agent.

Examples of the water-soluble organic solvent in the ink are: polyhydric alcohols, polyhydric alcohol derivatives, nitrous solvents, monohydric alcohols, and sulfurous solvents.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

<Treatment Liquid>

It is desirable in the present embodiment that the treatment liquid (aggregating treatment liquid) has effects of generating aggregation of the pigment and the polymer particles contained in the ink by producing a pH change in the ink when coming into contact with the ink.

Specific examples of the contents of the treatment liquid are: polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, derivatives of these compounds, and salts of these.

A treatment liquid having added thereto a polyvalent metal salt or a polyallylamine is to the preferred examples of the treatment liquid. The aforementioned compounds may be used individually or in combinations of two or more thereof.

From the standpoint of aggregation ability with the ink, the treatment liquid preferably has a pH of 1 to 6, more preferably a pH of 2 to 5, and even more preferably a pH of 3 to 5.

From the standpoint of preventing the nozzles of inkjet heads from being clogged by the dried treatment liquid, it is preferred that the treatment liquid include an organic solvent capable of dissolving water and other additives. A wetting agent and a penetrating agent are included in the organic solvent capable of dissolving water and other additives.

In order to improve fixing ability and abrasive resistance, the treatment liquid may further include a resin component. Any resin component may be employed, provided that the ejection ability from a head is not degraded when the treatment liquid is ejected by an inkjet system and also provided that the treatment liquid will have high stability in storage. Thus, water-soluble resins and resin emulsions can be freely used.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

First Modification of Embodiment

The fixing drum 84 on the circumferential surface of which the recording medium 24 is wrapped and held has been described as the medium holding device opposing the fixing roller 88 with reference to FIG. 1; however, the medium holding device is not limited to being a drum-shaped platen, and it is also possible to employ a flat plate-shaped pallet, belt, or the like.

Second Modification of Embodiment

The problems caused by the parting oil on the fixing roller 88 adhering onto the portion of the fixing drum 84 where no paper passes have been described with reference to FIG. 1; however, the present invention is not limited to the fixing roller and may also be applied to cases where similar problems occur in other roller members as well.

Third Modification of Embodiment

The inkjet recording apparatus 10 which prints only onto one surface of the recording medium 24 (i.e., the single-side machine) is shown in FIG. 1 and the mode where double-side printing is carried out by means of this same apparatus has been described; however, the range of application of the present invention is not limited to this. For example, it is possible to apply the present invention to a double-side printing machine in which two single-side machine compositions such as that shown in FIG. 1 are coupled together and a paper inverting mechanism is provided therebetween.

<Example of Application to Other Apparatus Compositions>

The above-described embodiments relate to application to the inkjet recording apparatus for printing, but the scope of application of the present invention is not limited to these. For instance, it can also be applied widely to other inkjet recording apparatuses which obtain various shapes and patterns by using a liquid functional material, such as a wiring printing apparatus which prints a wiring pattern for an electronic circuit, or manufacturing apparatuses for various devices, a resist printing apparatus using resin liquid as a functional liquid for ejection, or a fine structure forming apparatus which forms a fine structure by using a material deposition substance.

APPENDIX

As has become evident from the detailed description of the embodiments given above, the present specification includes disclosure of various technical ideas described below.

It is preferable that an inkjet recording apparatus comprises: an inkjet head which forms an image on a recording surface of a recording medium by ejecting ink to be deposited to the recording surface; a roller member which rotates in contact with the recording surface of the recording medium on which the image has been formed; an oil supply device which supplies oil to the roller member, the oil suppressing adherence of the ink to the roller member; a medium holding device which has a medium holding surface on which the recording medium is held while the roller member on which the oil has been deposited is making contact with the recording surface of the recording medium; and a cleaning sheet supply device which supplies a cleaning sheet to the medium holding device when a size of the recording medium is changed and an image is to be formed on a recording surface of the recording medium of large size compared to a size of the recording medium used before the change of size, the cleaning sheet removing the oil adhering to the medium holding surface of the medium holding device.

It is also preferable that an inkjet recording method comprises the steps of: forming an image on a recording surface of a recording medium by depositing ink ejected from an inkjet head onto the recording surface; supplying oil to a roller member which rotates in contact with the image recording surface of the recording medium on which the image has been formed, the oil suppressing adherence of the ink to the roller member; causing the roller member on which the oil has been deposited to make contact with the recording surface of the recording medium on which the image has been formed in a state where the recording medium is held on a medium holding surface of a medium holding device; and supplying a cleaning sheet to the medium holding device when a size of the recording medium is changed and an image is to be formed on a recording surface of the recording medium of large size compared to a size of the recording medium used before the change of size, the cleaning sheet removing the oil adhering to the medium holding surface of the medium holding device.

According to these aspects of the present invention, since the oil on the medium holding surface of the medium holding device is removed by the cleaning sheet when the recording medium size is changed, then it is possible to prevent adherence of the oil to the rear surface of the recording medium of large size after the change of size. By this means, it is possible to prevent image defects caused by application non-uniformities of the treatment liquid or repelling of the ink caused by the presence of oil.

The term "recording medium" includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

Possible modes of the conveyance device are a conveyance drum (conveyance roller) having a round cylindrical shape which is able to rotate about a prescribed rotational axis, or a conveyance belt, or the like.

Preferably, a Bristow permeability coefficient of the cleaning sheet with respect to water is not less than 0.1 ml/($m^2 \cdot msec^{1/2}$) and not more than 0.5 ml/($m^2 \cdot msec^{1/2}$), further preferably not less than 0.2 ml/($m^2 \cdot msec^{1/2}$).

Preferably, a surface roughness of a surface of the cleaning sheet on a side that makes contact with the medium holding surface of the medium holding device is not less than 0.2 μm and not more than 2.0 μm, further preferably not more than 1.0 μm, in terms of a center-line average roughness (Ra).

These aspects of the present invention provide desirable conditions for satisfying a good balance between the oil removal characteristics and the sheet passage characteristics, at the same time.

Preferably, the inkjet recording apparatus further comprises a cleaning sheet supply control device which controls a number of cleaning sheets supplied to the medium holding device in accordance with at least one of a number of prints made and a paper passage time of the recording medium used before the change.

Since there is a correlation between the amount of oil adhering to the medium holding device from the roller member and the number of prints made with the recording medium used before the size change, and the related paper passage time, then it is possible to optimize the consumption of cleaning sheets while achieving desired cleaning effects, by controlling the number of cleaning sheets passed in accordance with the number of prints made and the paper passage time before the size change.

Preferably, the roller member is a heat roller which fixes the image formed on the recording medium.

The present invention can be applied to a heat roller (fixing roller) which is disposed in the image fixing unit.

Preferably, the medium holding device has a drum shape and a circumferential surface thereof functions as the medium holding surface around which the recording medium is wrapped and held.

The present invention is suitable in a composition using the medium holding device having the drum shape.

Preferably, the recording medium of large size is a medium on which images are formed on both surfaces thereof; and the cleaning sheet is supplied to the medium holding device after changing the size of the recording medium to the large size and before forming the image on the recording medium of large size for a first time.

The present invention is particularly beneficial in the case of carrying out double-side printing, and makes it possible to form a satisfactory image on the rear surface side of the recording medium.

Preferably, the inkjet recording apparatus further comprises a treatment liquid deposition device which deposits a treatment liquid reacting with the ink onto the recording surface of the recording medium, wherein the ink is deposited from the inkjet head onto the recording surface of the recording medium on which the treatment liquid has been deposited.

According to this aspect of the present invention, adherence of the oil to the rear surface of the recording medium is prevented, and therefore application non-uniformities of the treatment liquid to the rear surface of the recording medium are improved, and good images can be formed.

Preferably, a recording medium of a size not smaller than the recording medium of large size is used as the cleaning sheet.

If the recording medium satisfies the required physical values of the cleaning sheet then it is possible to employ the recording medium for printing as the cleaning sheet.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an inkjet head which forms an image on a recording surface of a recording medium by ejecting ink to be deposited to the recording surface;

a roller member which rotates in contact with the recording surface of the recording medium on which the image has been formed;

an oil supply device which supplies oil to the roller member, the oil suppressing adherence of the ink to the roller member;

a medium holding device which has a medium holding surface on which the recording medium is held while the roller member on which the oil has been deposited is making contact with the recording surface of the recording medium; and a cleaning sheet supply device which supplies a cleaning sheet to the medium holding device when a size of the recording medium is changed and an image is to be formed on a recording surface of the recording medium of large size compared to a size of the recording medium used before the change of size, the cleaning sheet removing the oil adhering to the medium holding surface of the medium holding device, wherein a Bristow permeability coefficient of the cleaning sheet with respect to water is not less than 0.1 ml/($m^2 \cdot msec^{1/2}$) and not more than 0.5 ml/($m^2 \cdot msec^{1/2}$).

2. The inkjet recording apparatus as defined in claim 1, wherein a Bristow permeability coefficient of the cleaning sheet with respect to water is not less than 0.2 ml/($m^2 \cdot msec^{1/2}$) and not more than 0.5 ml/($m^2 \cdot msec^{1/2}$).

3. The inkjet recording apparatus as defined in claim 1, wherein a surface roughness of a surface of the cleaning sheet on a side that makes contact with the medium holding surface of the medium holding device is not less than 0.2 μm and not more than 2.0 μm in terms of a center-line average roughness (Ra).

4. The inkjet recording apparatus as defined in claim 1, wherein a surface roughness of a surface of the cleaning sheet on a side that makes contact with the medium holding surface of the medium holding device is not less than 0.2 μm and not more than 1.0 μm in terms of a center-line average roughness (Ra).

5. The inkjet recording apparatus as defined in claim 1, further comprising a cleaning sheet supply control device which controls a number of cleaning sheets supplied to the medium holding device in accordance with at least one of a number of prints made and a paper passage time of the recording medium used before the change.

6. The inkjet recording apparatus as defined in claim 1, wherein the roller member is a heat roller which fixes the image formed on the recording medium.

7. The inkjet recording apparatus as defined in claim 1, wherein the medium holding device has a drum shape and a circumferential surface thereof functions as the medium holding surface around which the recording medium is wrapped and held.

8. The inkjet recording apparatus as defined in claim 1, wherein:

the recording medium of large size is a medium on which images are formed on both surfaces thereof; and the cleaning sheet is supplied to the medium holding device after changing the size of the recording medium to the large size and before forming the image on the recording medium of large size for a first time.

9. The inkjet recording apparatus as defined in claim 1, further comprising a treatment liquid deposition device which deposits a treatment liquid reacting with the ink onto the recording surface of the recording medium, wherein the ink is deposited from the inkjet head onto the recording surface of the recording medium on which the treatment liquid has been deposited.

10. The inkjet recording apparatus as defined in claim 1, wherein a recording medium of a size not smaller than the recording medium of large size, which is used after changing the size of the recording medium, is used as the cleaning sheet.

11. An inkjet recording method, comprising the steps of:

forming an image on a recording surface of a recording medium by depositing ink ejected from an inkjet head onto the recording surface;

supplying oil to a roller member which rotates in contact with the image recording surface of the recording medium on which the image has been formed, the oil suppressing adherence of the ink to the roller member;

causing the roller member on which the oil has been deposited to make contact with the recording surface of the recording medium on which the image has been formed in a state where the recording medium is held on a medium holding surface of a medium holding device; and supplying a cleaning sheet to the medium holding device when a size of the recording medium is changed and an image is to be formed on a recording surface of the recording medium of large size compared to a size of the recording medium used before the change of size, the cleaning sheet removing the oil adhering to the medium holding surface of the medium holding device, wherein a Bristow permeability coefficient of the cleaning sheet with respect to water is not less than 0.1 ml/($m^2 \cdot msec^{1/2}$) and not more than 0.5 ml/($m^2 \cdot msec^{1/2}$).

12. The inkjet recording method as defined in claim 11, wherein a Bristow permeability coefficient of the cleaning sheet with respect to water is not less than 0.2 ml/($m^2 \cdot msec^{1/2}$) and not more than 0.5 ml/($m^2 \cdot msec^{1/2}$).

13. The inkjet recording method as defined in claim 11, wherein a surface roughness of a surface of the cleaning sheet on a side that makes contact with the medium holding surface of the medium holding device is not less than 0.2 μM and not more than 2.0 μm in terms of a center-line average roughness (Ra).

14. The inkjet recording method as defined in claim 11, wherein a surface roughness of a surface of the cleaning sheet on a side that makes contact with the medium holding surface of the medium holding device is not less than 0.2 μm and not more than 1.0 μm in terms of a center-line average roughness (Ra).

15. The inkjet recording method as defined in claim 11, wherein in the step of supplying the cleaning sheet, a number of cleaning sheets supplied is controlled in accordance with at least one of a number of prints made and a paper passage time of the recording medium used before the change.

16. The inkjet recording method as defined in claim 11, wherein:

the recording medium of large size is a medium on which images are formed on both surfaces thereof; and the cleaning sheet is supplied to the medium holding device after changing the size of the recording medium to the large size and before forming the image on the recording medium of large size for a first time.

17. The inkjet recording method as defined in claim 11, further comprising the step of depositing a treatment liquid reacting with the ink onto the recording surface of the recording medium, wherein in the step of forming the image, the ink is deposited from the inkjet head onto the recording surface of the recording medium on which the treatment liquid has been deposited.

18. The inkjet recording method as defined in claim 11, wherein in the step of supplying the cleaning sheet, a recording medium of a size not smaller than the recording medium of large size, which is used after changing the size of the recording medium, is used as the cleaning sheet.

* * * * *